US008468992B2

(12) United States Patent
Ruan et al.

(10) Patent No.: US 8,468,992 B2
(45) Date of Patent: Jun. 25, 2013

(54) IGNITER FOR IGNITING A FUEL/AIR MIXTURE IN A COMBUSTION CHAMBER, IN PARTICULAR IN AN INTERNAL COMBUSTION ENGINE, BY CREATING A CORONA DISCHARGE

(75) Inventors: Ganghua Ruan, Ludwigsburg (DE); Gerd Braeuchle, Hueffenhardt (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 243 days.

(21) Appl. No.: 13/151,473

(22) Filed: Jun. 2, 2011

(65) Prior Publication Data

US 2011/0297116 A1 Dec. 8, 2011

(30) Foreign Application Priority Data

Jun. 4, 2010 (DE) ..... 10 2010 023 102
Sep. 4, 2010 (DE) ..... 10 2010 045 171

(51) Int. Cl.
*F02P 23/00* (2006.01)
*F02P 23/04* (2006.01)

(52) U.S. Cl.
USPC ..... 123/143 B; 123/169 E

(58) Field of Classification Search
USPC ..... 123/143 B, 143 C, 598, 620, 169 R, 123/169 EL, 169 E; 313/141, 143, 118; 361/257
See application file for complete search history.

(56) References Cited

U.S. PATENT DOCUMENTS

| | | | | |
|---|---|---|---|---|
| 5,124,612 | A * | 6/1992 | Takamura et al. | 313/141 |
| 5,225,752 | A | 7/1993 | Yasuda et al. | |
| 5,471,362 | A | 11/1995 | Gowan | |
| 6,628,050 | B1 * | 9/2003 | Kameda et al. | 313/143 |
| 2004/0129241 | A1 | 7/2004 | Freen | |

FOREIGN PATENT DOCUMENTS

| | | | |
|---|---|---|---|
| DE | 197 47 700 | A1 | 5/1999 |
| DE | 10 2006 037 039 | A1 | 2/2008 |
| WO | WO 2010/011838 | A1 | 1/2010 |

* cited by examiner

*Primary Examiner* — Mahmoud Gimie

(57) ABSTRACT

Described is an igniter comprising an arrangement composed of an ignition electrode, an outer conductor coaxially enclosing the ignition electrode, and an electric insulator disposed between the ignition electrode and the outer conductor, via which insulator the ignition electrode and the outer conductor are interconnected, for igniting a fuel/air mixture in a combustion chamber, in particular in an internal combustion engine comprising one or more combustion chambers which are delimited by walls that are at ground potential, by creating a corona discharge in an area surrounding the tip of the ignition electrode. According to the invention, the ratio of the outer diameter d of the ignition electrode and the inner diameter D of the outer conductor is in the range of 0.3 to 0.44.

7 Claims, 3 Drawing Sheets

IGNITER FOR IGNITING A FUEL/AIR MIXTURE IN A COMBUSTION CHAMBER, IN PARTICULAR IN AN INTERNAL COMBUSTION ENGINE, BY CREATING A CORONA DISCHARGE

BACKGROUND OF THE INVENTION

Document WO 2004/063560 A1 discloses how a fuel/air mixture can be ignited in a combustion chamber of an internal combustion engine by a corona discharge created in the combustion chamber. For this purpose an ignition electrode is guided through one of the walls, that are at ground potential, of the combustion chamber in an electrically insulated manner and extends into the combustion chamber, preferably opposite a reciprocating piston provided in the combustion chamber. The ignition electrode constitutes a capacitance in cooperation with the walls of the combustion chamber that are at ground potential and function as counterelectrode. The combustion chamber and the contents thereof act as a dielectric. Air or a fuel/air mixture or exhaust gas is located therein, depending on which stroke the piston is engaged in.

The capacitance is a component of an electric oscillating circuit which is excited using a high-frequency voltage which is created, for example, using a transformer having a center tap. The transformer interacts with a switching device which applies a specifiable DC voltage to the two primary windings, in alternation, of the transformer connected by the center tap. The secondary winding of the transformer supplies a series oscillating circuit comprising the capacitance formed by the ignition electrode and the walls of the combustion chamber. The frequency of the alternating voltage which excites the oscillating circuit and is delivered by the transformer is controlled such that it is as close as possible to the resonance frequency of the oscillating circuit. The result is a voltage step-up between the ignition electrode and the walls of the combustion chamber in which the ignition electrode is disposed. The resonance frequency is typically between 30 kilohertz and 3 megahertz, and the alternating voltage reaches values at the ignition electrode of 50 kV to 500 kV, for example.

A high-frequency corona discharge can therefore be created in the combustion chamber. The corona discharge should not break down into an arc discharge or a spark discharge. Measures are therefore implemented to ensure that the voltage between the ignition electrode and the combustion chamber walls, which are at ground potential, remains below the voltage required for a complete breakdown.

The space that is available in an internal combustion engine for guiding the ignition electrode, and the insulator enclosing same, through a combustion chamber wall, in particular through the cylinder head of a piston engine, is limited, especially in modern engines for passenger vehicles, in which case a threaded hole of M10 to maximum M14 is typically provided for screwing in a spark plug, and therefore an outer diameter of no more than 10 mm is available for the insulator of an igniter according to the invention. Moreover, there are demands to further reduce the size of the threaded holes in the cylinder head. Considering the high requirements placed primarily on the insulation capacity of the insulator—high voltages in the range of 50 kV to 100 kV at frequencies in the range of 30 kHz to 3 MHz, combined with small passage openings in the combustion chamber walls, high and fluctuating pressures and temperatures in the combustion chamber, and attacks by the combustion chamber atmosphere—engineers involved in the development of a igniter according to the invention for internal combustion engines face considerable challenges, especially since the continual reduction in diameter of the outer conductor and of the ignition electrode in particular increases the risk that the insulator will become overloaded by the high voltages and electric field strengths. Given the high voltage between the ignition electrode and the surrounding outer conductor required to generate a corona discharge, as the outer diameter of the ignition electrode is continually reduced and the inner diameter of the outer conductor is continually reduced, so does the risk increase that the maximum electric field strength generated by the high frequency will exceed the breakdown strength of the insulator and voltage breakdowns will occur in the insulator.

SUMMARY OF THE INVENTION

The problem addressed by the present invention is that of creating an igniter of the initially stated type, which meets these challenges better than ever before.

This problem is solved by an igniter having the features of the present invention. Advantageous developments of the invention are further explained below.

In order to ignite a fuel/air mixture in a combustion chamber, in particular in an internal combustion engine having one or more combustion chambers delimited by walls that are at ground potential, by creating a high-frequency corona discharge in an area surrounding the tip of an ignition electrode, the igniter according to the invention comprises an arrangement composed of the ignition electrode, an outer conductor coaxially enclosing the ignition electrode, and an electric insulator disposed between the ignition electrode and the outer conductor, via which insulator the ignition electrode and the outer conductor are interconnected, wherein the ratio of the outer diameter d of the ignition electrode and the inner diameter D of the outer conductor is in the range of 0.3 to 0.44. It is therefore possible to minimize the risk of overloading the insulator and, in particular, the risk of voltage breakdowns in the insulator. At the same time, the number of misfirings in the combustion chamber is minimized and the formation of a large corona is promoted, thereby improving ignition and combustion. A further advantage is that fuel consumption can be reduced, the service life of the igniter can be increased, and maintenance and repair costs can be reduced. A further advantage of the invention is that, by optimizing the igniter, a lower-cost insulator having less than favorable insulation capacity may be used in certain circumstances, thereby reducing the production costs for the automotive manufacturer. The invention promotes the miniaturization of the igniter and therefore fulfills a requirement of the automotive manufacturers.

The diameter ratio d/D is preferably in the range of 0.34 to 0.40. Preferably the diameter ratio d/D=0.37 is selected.

The claimed diameter ratios apply strictly for the case of an insulator, the insulating properties of which are substantially uniform along the length thereof and across the cross section thereof, and the cross section of which is circular or approximately circular. As deviations from the circular cross section increase, the optimal diameter ratio can deviate from the value 0.37.

It is advantageous for the ignition electrode to be cylindrical at least where it is enclosed by the outer conductor. If the outer conductor has a non-uniform inner diameter along the length thereof, e.g. a conical section, then the claimed diameter ratio should apply at least for the smallest inner diameter of the outer conductor, because this is where the risk of overloading the insulator and of voltage breakdowns in the insulator is greatest. However, when the outer conductor does not have a constant inner diameter along the length thereof, the diameter of the ignition electrode is preferably adapted to the course of the diameter of the outer conductor such that the diameter ratio, and particularly the optimal diameter ratio that is claimed, is attained and an increase in the field strength is prevented.

BRIEF DESCRIPTION OF THE DRAWINGS

The invention is explained in greater detail below with reference to the attached schematic drawings.

DETAILED DESCRIPTION

Figure 1:
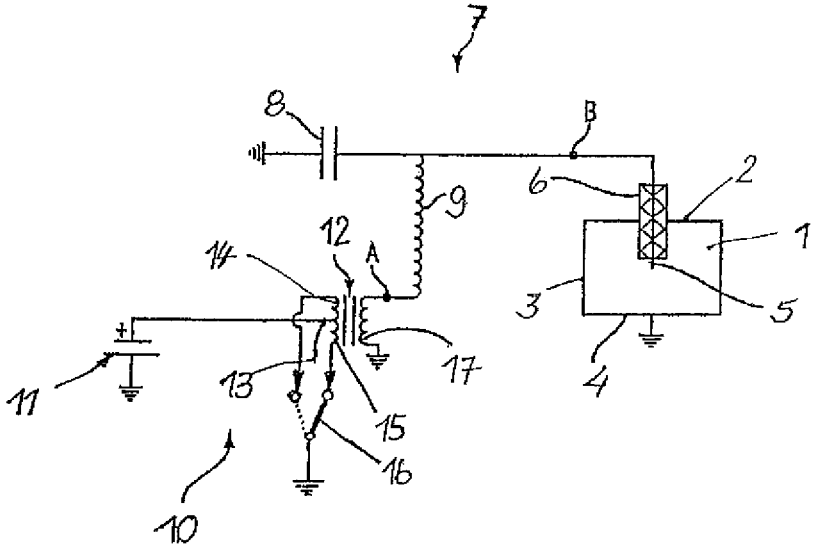
FIG. 1 shows a schematic depiction of the design of an ignition system for a vehicle engine.
Figure 2:
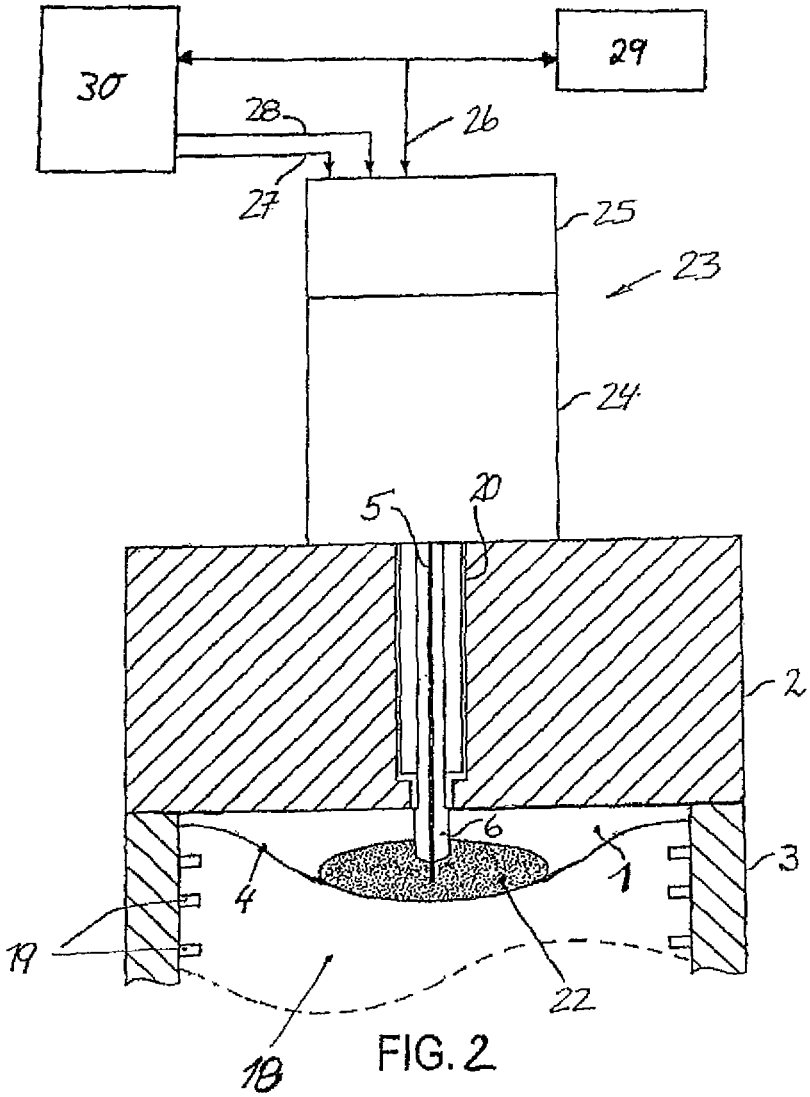
FIG. 2 shows a longitudinal cross section of a cylinder of an internal combustion engine, which is connected to the ignition system shown in FIG. 1.

FIGS. 1 and 2 show a schematic depiction of an ignition system of the type disclosed in WO 2010/011838 A1. FIG. 1 shows a combustion chamber 1 which is delimited by walls 2, 3, and 4 that are at ground potential. An ignition electrode 5 which is enclosed by an insulator 6 along a portion of the length thereof extends into combustion chamber 1 from above, and is guided through upper wall 2 into combustion chamber 1 in an electrically insulated manner by way of said insulator. Ignition electrode 5 and walls 2 to 4 of combustion chamber 1 are part of a series oscillating circuit 7 which also includes a capacitor 8 and an inductance 9. Of course, series oscillating circuit 7 can also comprise further inductors and/or capacitors, and other components that are known to a person skilled in the art as possible components of series oscillating circuits.

A high-frequency generator 10 is provided for excitation of oscillating circuit 7, and comprises a DC voltage source 11 and a transformer 12 having a center tap 13 on the primary side thereof, thereby enabling two primary windings 14 and 15 to meet at center tap 13. Using a high-frequency switch 16, the ends of primary windings 14 and 15 opposite center tap 13 are connected to ground in alternation. The switching rate of high-frequency switch 16 determines the frequency with which series oscillating circuit 7 is excited, and can be changed. Secondary winding 17 of transformer 12 supplies series oscillating circuit 7 at point A. High-frequency switch 16 is controlled using a not-shown control loop such that the oscillating circuit is excited with the resonant frequency thereof. The voltage between the tip of ignition electrode 5 and walls 2 to 4 that are at ground potential is therefore at a maximum.

FIG. 2 shows a longitudinal cross section of a cylinder of an internal combustion engine equipped with the ignition device depicted schematically in FIG. 1. Combustion chamber 1 is limited by an upper wall 2 in the form of a cylinder head, a cylindrical circumferential wall 3, and top side 4 of a piston 18 which is equipped with piston rings 19 and can move back and forth in the cylinder.

Cylinder head 2 comprises a passage 20 through which ignition electrode 5 is guided in an electrically insulated and sealed manner. Ignition electrode 5 is enclosed along a portion of the length thereof by an insulator 6 which can be composed of a sintered ceramic, e.g. an aluminium oxide ceramic. Ignition electrode 5 extends via the tip thereof into combustion chamber 1 and extends slightly past insulator 6, although it could be flush therewith.

When oscillating circuit 7 is excited, a corona discharge forms between ignition electrode 5 and piston 18, and is accompanied by a more or less intensive charge carrier cloud 22.

A housing 23 is placed onto the outer side of cylinder head 2. Primary windings 14 and 15 of transformer 12, and high-frequency switch 16 interacting therewith, are located in a first compartment 24 of housing 23. A second compartment 25 of housing 23 contains secondary winding 17 of transformer 12 and the remaining components of series oscillating circuit 7, and, optionally, means for observing the behavior of oscillating circuit 7. An interface 26 can be used to establish a connection, for example, to a diagnostic unit 29 and/or an engine control unit 30. However, transformer 12 does not necessarily have to be accommodated in a housing mounted on cylinder head 2, but rather can be located together with high-frequency switches 16 in a separate ignition control unit which, in turn, can be connected to engine control unit 30. The remaining parts of the series oscillating circuit can be located in a housing which encloses insulator 6.

Figure 4:
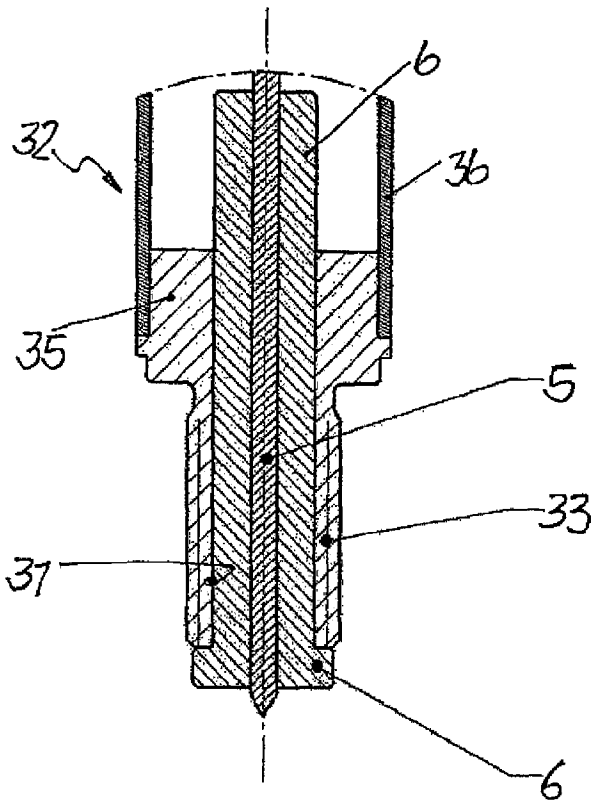
FIG. 4 shows a cross section of detail IV in FIG. 3, in an enlarged view.
Figure 3:
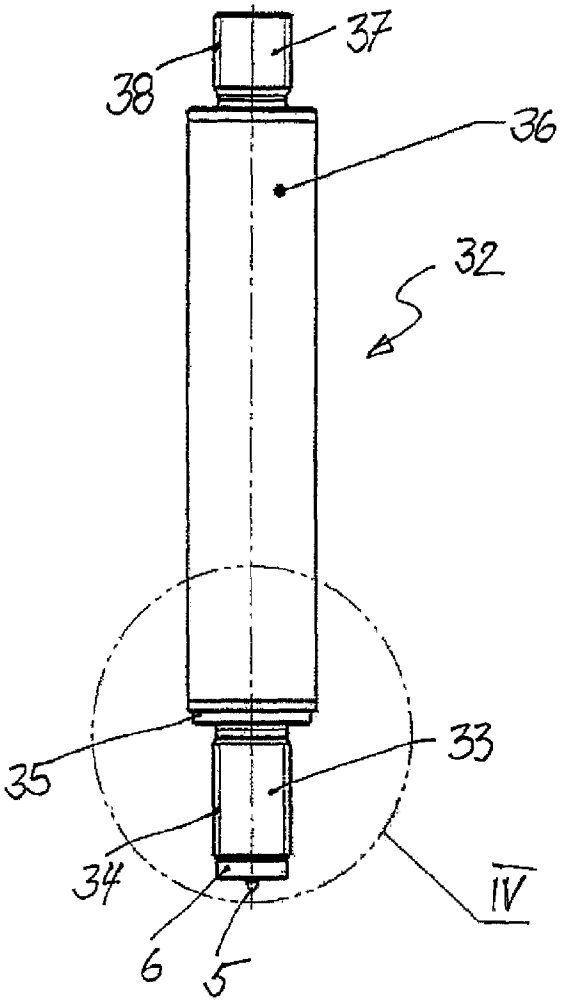
FIG. 3 shows an igniter according to the invention, in a side view.

The igniter depicted in FIGS. 3 and 4 comprises a substantially cylindrical ignition electrode 5 which comes to a point at the end thereof which extends into a combustion chamber. Ignition electrode 5 extends through a substantially cylindrical housing 32 which is subdivided into two sections. A front section 33, which is preferably composed of steel, is equipped with an outer thread 34 via which it can be screwed into a threaded hole in a combustion chamber, in particular into a threaded hole in the cylinder head of a piston engine. Front section 33 of housing 32 has an inner diameter D which remains constant along the length thereof. The outer diameter thereof expands at the termination of outer thread 34 to form a thickened section 35 which is securely connected to a tube 36 which forms the rear section of housing 32 and can be composed of aluminum, for instance. A fitting 37 is provided at the end of tube 36, which is equipped with an outer thread 38 and is used as the electrical connection of the igniter and ignition electrode 5 thereof. The electrical connection of the igniter can also be established using a coaxial plug which is connected via a coaxial cable to an ignition control device. Housing 32, including front part 33 thereof and tube 36, is used as outer conductor and is at ground potential during operation of the igniter.

A high-frequency voltage is generated between housing 32 and ignition electrode 5, and so ignition electrode 5 is insulated by a preferably ceramic insulator 6 with respect to the outer conductor formed by parts 33 and 36 of housing 32. Insulator 6 hermetically seals the interior space of the igniter with respect to the combustion chamber. In the region of front section 33 of housing 32, the ratio between the outer diameter d of ignition electrode 5 and the inner diameter D of front part 33 of housing 32, which is used as outer conductor, is set at a value d/D of 0.3 to 0.44, and optimally at a value of 0.37. Between the tip of ignition electrode 5 and the front end of front part 33 of housing 32, which is used as outer conductor, the outer diameter of insulator 6 is widened and therefore shields the tip of ignition electrode 5 from the front edge of front housing part 33.

LIST OF REFERENCE NUMERALS

1. Combustion chamber
2. Wall
3. Wall
4. Wall

5. Ignition electrode
6. Insulator
7. Oscillating circuit
8. Capacitor
9. Inductor
10. High-frequency generator
11. DC voltage source
12. Transformer
13. Center tap
14. Primary winding
15. Primary winding
16. High-frequency switch
17. Secondary winding
18. Piston
19. Piston ring
20. Passage
21. ---
22. Charge carrier cloud
23. Housing
24. Compartment
25. Compartment
26. Interface
27. ---
28. ---
29. Diagnostic unit
30. Engine control unit
31. Outer conductor
32. Housing
33. Front section of 32
34. Outer thread
35. Thickened section
36. Tube
37. Fitting
38. Outer thread

What is claimed is:

1. An igniter for igniting a fuel/air mixture in a combustion chamber of an internal combustion engine having one or more combustion chambers delimited by walls that are at ground potential, by creating a corona discharge in an area surrounding a tip of the igniter, said igniter comprising:

an ignition electrode;

an outer conductor coaxially enclosing the ignition electrode; and an electric insulator interconnecting the ignition electrode and the outer conductor and wherein a diameter ratio between an outer diameter, d, of the ignition electrode and an inner diameter, D, of the outer conductor is in the range of 0.3 to 0.44.

2. The igniter according to claim 1, wherein the diameter ratio is in the range of 0.34 to 0.40.

3. The igniter according to claim 1, wherein the diameter ratio is selected to be 0.37.

4. The igniter according to claim 1, wherein a cross section of the ignition electrode is circular or approximately circular.

5. The igniter according to claim 4, wherein the ignition electrode is cylindrical at least where it is enclosed by the outer conductor.

6. The igniter according to claim 1, wherein the outer conductor has a non-uniform inner diameter along a length of the outer conductor, and the claimed diameter ratio applies at for a smallest inner diameter of the outer conductor.

7. The igniter according to claim 1, wherein the outer conductor has a non-uniform inner diameter along a length of the outer conductor, and the diameter ratio is uniform and between 0.3 to 0.44 along the outer conductive length.

* * * * *